US005224630A

United States Patent [19]

Pope et al.

[11] Patent Number: 5,224,630

[45] Date of Patent: Jul. 6, 1993

[54] PRESSURIZED CONTAINER HAVING DOUBLE WALLS AND SAFETY VENTING FEATURE

[75] Inventors: John Pope, Wendover; Barry J. Steptoe, Stevenage, both of United Kingdom

[73] Assignee: Hoechst (UK) Limited, Hertsfordshire, United Kingdom

[21] Appl. No.: 761,742

[22] PCT Filed: Jan. 15, 1991

[86] PCT No.: PCT/GB91/00050

§ 371 Date: Sep. 16, 1991

§ 102(e) Date: Sep. 16, 1991

[87] PCT Pub. No.: WO91/10606

PCT Pub. Date: Jul. 25, 1991

[30] Foreign Application Priority Data

Jan. 16, 1990 [GB] United Kingdom ..... 9000984

[51] Int. Cl.[5] ..... B67D 5/06

[52] U.S. Cl. ..... 222/183; 222/397; 222/402.1

[58] Field of Search ..... 222/130, 183, 397, 402.1

[56] References Cited

U.S. PATENT DOCUMENTS

| | | | |
|---|---|---|---|
| 3,225,967 | 12/1965 | Heimgartner | 222/183 |
| 4,222,499 | 9/1980 | Lee et al. | 222/183 |
| 4,964,540 | 10/1990 | Katz | 222/183 X |

FOREIGN PATENT DOCUMENTS

| | | |
|---|---|---|
| 1286026 | 1/1962 | France . |
| 2546485 | 11/1984 | France . |
| 788108 | 12/1957 | United Kingdom . |
| 2214891 | 9/1989 | United Kingdom . |

*Primary Examiner*—Gregory L. Huson

*Attorney, Agent, or Firm*—Christie, Parker & Hale

[57] ABSTRACT

A plastics container for pressurized materials, such as an aerosol container, includes an inner vessel and an outer vessel. The vessels are both necked and are in contact throughout their extent but only bonded together at the respective necks. A valve is mounted at the necks. This configuration allows a container which will not endanger the user if the outer vessel is fractured. To enable the inner vessel to vent safely after a fracture of the outer vessel, it is provided with at least one perforation formed by an orifice.

11 Claims, 1 Drawing Sheet

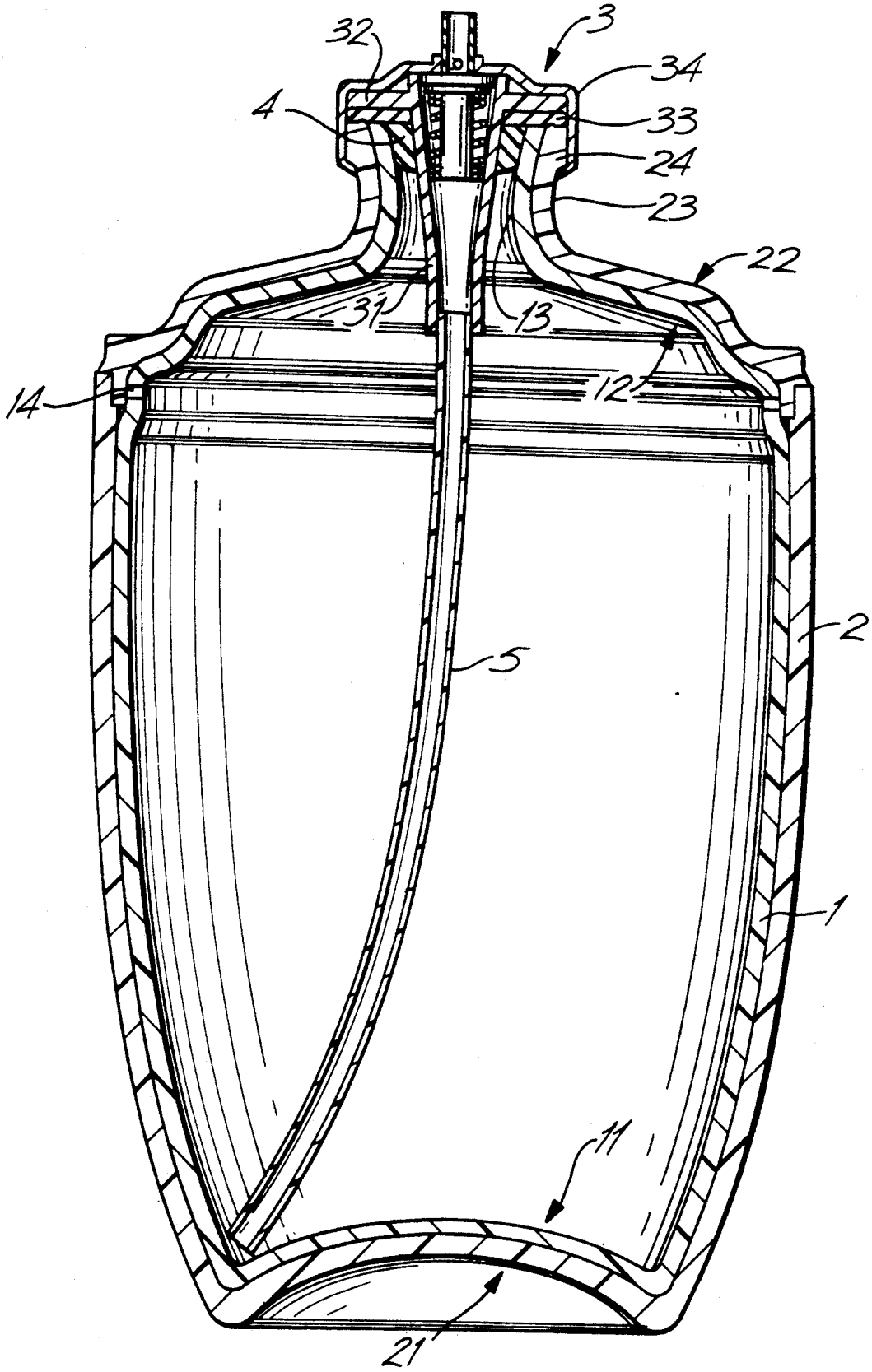
32
3
34
4
33
24
23
22
31
13
14
12
2
5
1
11
21

PRESSURIZED CONTAINER HAVING DOUBLE WALLS AND SAFETY VENTING FEATURE

BACKGROUND OF THE INVENTION

The invention relates to a container.

In particular it relates to a container for pressurised materials, such as an aerosol container.

Aerosol containers having double walls are known. These have various disadvantages known to persons skilled in the art.

SUMMARY OF THE INVENTION

An object of the present invention is to provide a double-walled container which will not endanger the user if the outer wall is fractured, for example by the container being dropped.

According to the present invention there is provided a container for pressurised materials, comprising an inner vessel having a neck closed by a valve and an outer vessel having a neck, the inner and outer vessels being of plastics materials, wherein the outer vessel envelopes the inner vessel except for the valve such that the inner neck is situated within the outer neck.

The inner and outer vessels are preferably not bonded together except at the top part of their necks where they are mechanically bonded together with the use of a collar engaging the inner surface of the inner neck and the ferrule of the valve engaging the outer surface of the outer neck.

To enable the inner vessel to vent safely when the outer vessel is fractured the inner vessel may be perforated by at least one orifice.

In a preferred embodiment the perforation is formed by a plurality of orifices positioned in the area or areas of greatest weakness of the outer vessel.

BRIEF DESCRIPTION OF THE DRAWING

The accompanying diagrammatic drawing shows a preferred embodiment of a container according to the invention in axial section.

The illustrated container comprises an inner vessel 1 which has a body provided at one end with a bottom portion 11 and at the other with a shoulder portion 12 merging into a neck (hereinafter: inner neck 13). In use, the inner vessel 1 contains a pressurised substance, e.g. a product and propellant.

The container further comprises an outer vessel 2 which has a body provided at one end with a base portion 21 and at the other with a shoulder portion 22 merging into a neck (hereinafter: outer neck 23) provided with an outer flange 24. As is apparent from the drawing the outer vessel 2 completely envelopes the inner vessel 1 such that the upper surfaces of the inner neck 13 and outer neck 23 are contained substantially in the same plane.

The aerosol valve 3 is a so-called external crimped valve known per se which comprises a tapering valve body 31 provided with an external flange 32, a gasket 33 and a ferrule 34 (aluminium skirt).

Inside the inner neck 13 is situated a collar 4 through which passes the body 31 of the valve 3 whereby the inner neck 13 is closed.

On the upper surfaces of the necks 13 and 23 and the upper surface of the collar 4 sits the gasket 33 which supports the flange 32 and thereby also the valve body 31.

The inner vessel 1 and the outer vessel 2 are a close fit for the entirety of their adjacent surfaces but they are not mechanically bonded together except at the valve. This mechanical bonding is obtained by the radial pressure exerted on the necks 13 and 23 by the collar 4 and the ferrule 34 crimped below the flange 24 of the outer neck 23.

To the inner narrow end of the tapering valve body 31 is attached a dip tube 5. The remaining parts of the valve 3 are known per se and need not be discussed.

The inner vessel 1 is provided with orifices 14. Two such orifices 14 are illustrated although any number between one and twenty . or more may be used in practice. If the orifices are of circular cross-section their diameter may, for example, be in the range of 0.1 to 5 mm. The orifices 14 are preferably positioned in the area or areas of greatest weakness of the outer vessel 2. In the illustrated embodiment the outer vessel 2 is composed of two parts, namely a lower part, comprising the body and bottom portion 21, and an upper part, comprising the shoulder portion 22 with the outer neck 23. The two parts of the outer vessel 2 are either welded together (shown) or they may be snap fitted together using the natural properties of the material of which they are made. The area where the two parts are connected together is often, but not necessarily, the weakest portion of the outer vessel 2.

The inner vessel 1 is preferably made by extrusion blow moulding of a plastics material, preferably a polymer such as polypropylene, polyetheylene, polyamide or thermoplastic polyester elastomer. The outer vessel 2 is preferably made by injection moulding of a plastics material, preferably a polymer such as polyacetal, polyamide or thermoplastic polyester. These manufacturing techniques are well known.

The base portion 21 of the outer vessel 2 is preferably made as disclosed in PCT Application No WO 90/06263 (Application No PCT/GB 89/01422) while the shoulder region of the outer vessel 2 is preferably made as disclosed in PCT Application No PCT/GB 90/01088.

The inner and outer vessels may be bonded or secured together by any other securing means than the collar and ferrule of the valve.

What is claimed is:

1. A container for pressurized materials comprising an inner vessel having a neck, a valve for closing the neck of the inner vessel, and an outer vessel having a neck, the outer vessel being disposed around the inner vessel and being in contact with the inner vessel over an entire outer surface of the inner vessel;

the neck of the inner vessel being disposed within the neck of the outer vessel;

wherein the valve comprises means for pressing the neck of the inner vessel and the neck of the outer vessel together, said means comprising a collar engaging the inner surface of the neck of the inner vessel and a ferrule engaging the outer surface of the neck of the outer vessel; and wherein the inner vessel includes one or more orifices defined therein, for enabling the inner vessel to vent safely in response to rupture of the outer vessel.

2. A container as claimed in claim 1 wherein the inner and outer vessels are fixed together only by the valve.

3. A container as claimed in claim 1 wherein each orifice is positioned in an area of relative weakness of the outer vessel.

4. A container as claimed in claim 1 wherein the outer vessel comprises a shell having two parts integrally joined together.

5. A container as claimed in claim 4 wherein the two parts are welded together.

6. A container as claimed in claim 4 wherein the two parts are snap-fitted together.

7. A container as claimed in claim 1 wherein the outer vessel is of polyacetal, polyamide or a thermoplastic polyester.

8. A container as claimed in claim 1 wherein the inner vessel is of polypropylene, polyethylene, polyamide or a thermoplastic polyester elastomer.

9. A container as claimed in claim 1 wherein the inner vessel comprises plastic and is made by extrusion blow molding.

10. A container as claimed in claim 1 wherein the outer vessel comprises plastic and is made by injection molding.

11. A container as claimed in claim 1 wherein the inner and outer vessels comprise plastic.

* * * * *